US008523009B2

(12) United States Patent
Woinarski

(10) Patent No.: US 8,523,009 B2
(45) Date of Patent: Sep. 3, 2013

(54) CONTAINER CLOSURE WITH DEFORMABLE REGION IN SKIRT TO ALLOW PIVOTING

(75) Inventor: David Alexander Woinarski, Potts Point (AU)

(73) Assignee: Innovative Design Co., Pty Ltd., Potts Point, NSW (AU)

( * ) Notice: Subject to any disclaimer, the term of this patent is extended or adjusted under 35 U.S.C. 154(b) by 750 days.

(21) Appl. No.: 11/909,890

(22) PCT Filed: Mar. 31, 2006

(86) PCT No.: PCT/AU2006/000436

§ 371 (c)(1),
(2), (4) Date: Apr. 1, 2008

(87) PCT Pub. No.: WO2006/102721

PCT Pub. Date: Oct. 5, 2006

(65) Prior Publication Data

US 2009/0014456 A1 Jan. 15, 2009

(30) Foreign Application Priority Data

Mar. 31, 2005 (AU) ..... 2005901579

(51) Int. Cl.

| | |
|---|---|
| ***B65D 21/00*** | (2006.01) |
| ***B65D 85/62*** | (2006.01) |
| ***B65D 45/16*** | (2006.01) |
| ***B65D 39/00*** | (2006.01) |
| ***B65D 43/04*** | (2006.01) |
| ***B65D 55/02*** | (2006.01) |

(52) U.S. Cl.
USPC ..... 220/802; 220/324; 220/326; 220/790; 215/211; 206/503; 206/508

(58) Field of Classification Search
USPC ..... 220/802, 790, 324, 326; 215/211; 206/503, 508
See application file for complete search history.

(56) References Cited

U.S. PATENT DOCUMENTS 4,034,889 A * 7/1977 Hammes et al. ..... 220/324
4,512,493 A * 4/1985 Von Holdt ..... 220/782

(Continued)

FOREIGN PATENT DOCUMENTS

EP 0 147 507 7/1985
GB 2 091 706 8/1982

(Continued)

OTHER PUBLICATIONS

International Search Report dated Jun. 6, 2006, directed to counterpart application No. PCT/AU2006/000436 (3 pages).

*Primary Examiner* — Anthony Stashick
*Assistant Examiner* — Andrew T Kirsch
(74) *Attorney, Agent, or Firm* — Morrison & Foerster LLP

(57) ABSTRACT

A closure for a container includes a base and a peripheral wall, which may have a rim forming an upper margin of the peripheral wall and surrounding the opening of the container. The rim may have an external protrusion formed integrally with and surrounding the rim. The closure may have an overlying closure portion overlying the opening of the container when the closure is mounted on the container and a skirt formed integrally with the overlying closure portion to surround the rim when the closure is mounted to the container. The skirt includes a first portion adjacent to and surrounding an external upper end of the rim and a second portion connected to the first portion via a connection. The second portion may extend downwardly from the first portion to surround the rim below its upper end when the closure is mounted on the container.

8 Claims, 7 Drawing Sheets

(56) References Cited

U.S. PATENT DOCUMENTS

| | | | | | |
|---|---|---|---|---|---|
| 4,721,210 | A | * | 1/1988 | Lawrence et al. | 206/459.1 |
| 4,919,286 | A | * | 4/1990 | Agbay, Sr. | 215/235 |
| 5,730,309 | A | * | 3/1998 | Jiradejnunt et al. | 220/276 |
| 5,979,690 | A | * | 11/1999 | Hartley | 220/266 |

FOREIGN PATENT DOCUMENTS

| | | |
|---|---|---|
| WO | WO 90/09329 | 8/1990 |
| WO | WO 99/58412 | 11/1999 |
| WO | WO 2004/106185 | 12/2004 |

* cited by examiner

CONTAINER CLOSURE WITH DEFORMABLE REGION IN SKIRT TO ALLOW PIVOTING

REFERENCE TO RELATED APPLICATIONS

This application is a national stage application under 35 USC 371 of International Application No. PCT/AU2006/000436, filed Mar. 31, 2006, which claims priority from an Australian patent application No. 2005901579, filed Mar. 31, 2005, the entire contents of which are incorporated herein by reference.

BACKGROUND OF THE INVENTION (i). Field of the Invention

An improved closure for a container is disclosed wherein at least the closure (eg. in the form of a lid) is moulded from plastic. More particularly, the closure is adapted for reuse, but to also indicate tampering once initially removed.

(ii). Description of the Related Art

Plastic and metal containers such as pails are used for holding chemicals including paints, solvents, oils, powders etc. It is desirable that the closure does not become detached from the container as a result of inadvertent dropping of the container and/or from shifting loads during handling, transport etc. At the same time, it is desirable that the closure be readily removable when access to container contents is required.

GB 2091706 discloses a container lid provided with a lid flange that merges into a releasing flange. The releasing flange can assume a position in which an inwardly extending rib of the flange can engage a sealing edge on a container flange or a container external bead. The releasing flange is fabricated to have a thin cross-section so that it can act as a bistable snap catch to be pivoted to an extreme position to release from the container flange or external bead, and be retained thereat by means of its inherent annular tension.

WO 2004/106185 discloses a container-closure arrangement in which the container comprises external and internal beads formed at the container rim, and a closure having first and second ledges for interlocking engagement with the respective external and internal beads. However, to enable closure removal from the container, a tear strip comprising the first ledge requires detachment from the closure so that the first ledge can be moved from its interlocking engagement with the external bead.

A reference herein to a prior art document is not an admission that the document forms a part of the common general knowledge of a skilled person in Australia or elsewhere.

SUMMARY OF THE INVENTION

A closure is provided for a container that comprises a base and peripheral wall, with a rim forming an upper margin of the wall and surrounding an opening of the container, and an external protrusion formed integrally with and surrounding the rim;

a portion of the closure being adapted to overlie the opening of the container, with a skirt formed integrally with the closure portion and arranged to surround the rim when the closure is mounted to the container, the skirt comprising a first portion positionable adjacent to and to surround an external upper end of the rim, and a second portion that is connected to the first portion at a connection and that extends downwardly therefrom to surround the rim below its upper end, the second portion comprising an integrally formed first ledge located therewithin, the first ledge being positionable to locate in interlocking engagement with the external protrusion;

wherein at least one region of deformability is defined in the second portion at a location away from the connection such that, with the closure mounted on the container, the at least one region can deform to facilitate pivoting of the second portion with respect to the first portion to disengage the first ledge from the external bead.

By providing at least one region of deformability in the second portion it has been observed that its pivoting is more easily enabled. However, region deformation during pivoting can also indicate tampering with the closure, and hence potential tampering with container contents.

In one form the second portion is adapted to pivot to a position whereby closure removal from the container is enabled. This position may comprise a stable position whereby the second portion can be adapted to maintain itself in that position once pivoted thereto. In this regard, the second portion typically has a substantial cross-sectional thickness such that, without the at least one region of deformability, pivoting of the second portion to the stable position is either rendered difficult or prevented. The substantial cross-sectional thickness can be contributed to in part by the first ledge.

The at least one region of deformability is also compatible for use with a closure and container that employ primary and secondary locking of the closure with the container. In this regard, the interlocking engagement of the first ledge with the external protrusion can provide a "primary locking" of the closure to the container. To provide "secondary locking" an internally extending protrusion can be formed integrally with and around the container rim to project inwardly from the rim. Then, a second ledge can be formed integrally with the closure portion that can interlockingly engage with the internal protrusion when the closure is mounted on the container. Disengagement of the first ledge from the external protrusion thus releases the primary locking, whereby closure removal from the container then requires only the secondary locking to be disengaged. Thereafter, upon closure re-mounting to the container, the secondary locking can be re-engaged (via the second ledge and internal protrusion) to securely remount the closure to the container, whether or not the primary locking is re-engaged. The provision of primary and secondary locking also facilitates a more secure mounting of the closure to the container (eg. during transport, storage etc) such that, when the closure is initially mounted on the container, it is secured thereto on both sides of the rim.

The external and internal protrusions may be provided in the form of beads that are integrally formed with the container rim.

The at least one region of deformability can be provided as a web (eg. of reduced thickness compared to the rest of the second portion) that extends transversely through the second portion, or may be defined by a line of weakness or severance, or simply by a thinning of material in a given region. In addition, during pivoting of the second portion with respect to the first portion, the region of deformability may stretch or break. Typically at least two regions of deformability are provided in the second portion, for example, located on opposite sides of the closure.

In one form of the container, a container flange can be formed integrally with and to extend out from the container wall below the rim. The container flange typically functions to strengthen the container adjacent to the rim. Typically the length of the second portion is such that its distal end is positioned adjacent to the container flange when the closure is mounted to the container, typically in a close facing relationship (which can include abutment of the second portion distal end at the container flange). Locating the distal end of the second portion adjacent to the container flange can further assist with tamper proofing the arrangement. For example, an attempt to remove the closure from the container may require the insertion of an implement (eg. a blade) between the second portion distal end and the container flange, which may then be detected (eg. as a deformation of either of both of the second portion or flange).

However, in one embodiment the container flange is typically provided with one or more recesses adapted for receiving finger(s) of a user therein to facilitate finger insertion under and lifting of the second portion, thus facilitating initiation of pivoting of the second portion with respect to the first portion. In another embodiment the second portion can be provided with one or more recesses adapted for receiving finger(s) of a user therein to facilitate finger insertion under and lifting, and thus initiation of second portion pivoting.

BRIEF DESCRIPTION OF THE DRAWINGS

Notwithstanding other embodiments which may incorporate some or all of the closure features as outlined in the Summary, a number of specific closure and container embodiments will now be described, by way of example only, with reference to the accompanying drawings in which.

DETAILED DESCRIPTION OF THE INVENTION

Figure 1:
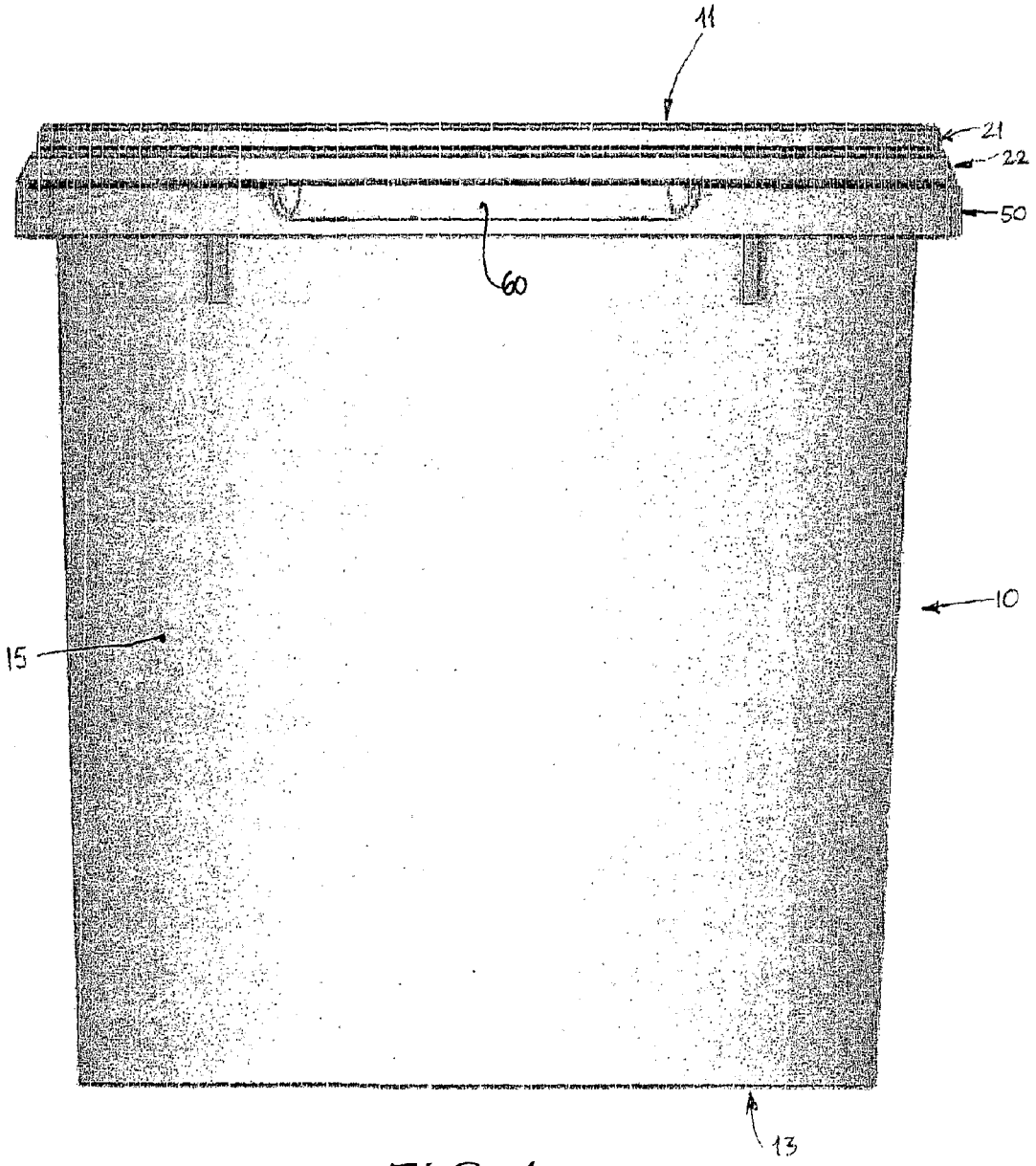
FIG. 1 shows a side view of an assembled container-closure arrangement.

Referring to FIG. 1, an assembled container-closure arrangement is depicted comprising a container in the form of a pail 10, and a closure in the form of a lid 11. Whilst the arrangement is typically employed with a circular pail and lid as shown, the arrangement may be employed with square or rectangular pails and lids etc.

The pail and lid may each be moulded from polypropylene or high density polyethylene. The pail may be moulded in any desired size and may have a volumetric capacity in the order of eg. 0.5 to 20 liters. The pail may also be formed from a metal material. In addition, the lid-pail arrangements are suited to both tapered (FIG. 1) and straight-sided containers.

The pail 10 has a base 13 which is sized so that it can be located at a recess portion of the lid. In this regard, the recess portion includes a generally flat central region 14 (FIG. 2) whereby the base of an overlying pail can be positioned at region 14, so that a number of the pail-lid arrangements may be stacked one upon another. The pail has a peripheral wall 15, with a rim 16 forming an upper margin of the wall 15 and surrounding an opening of the pail (FIG. 3).

Figure 2:
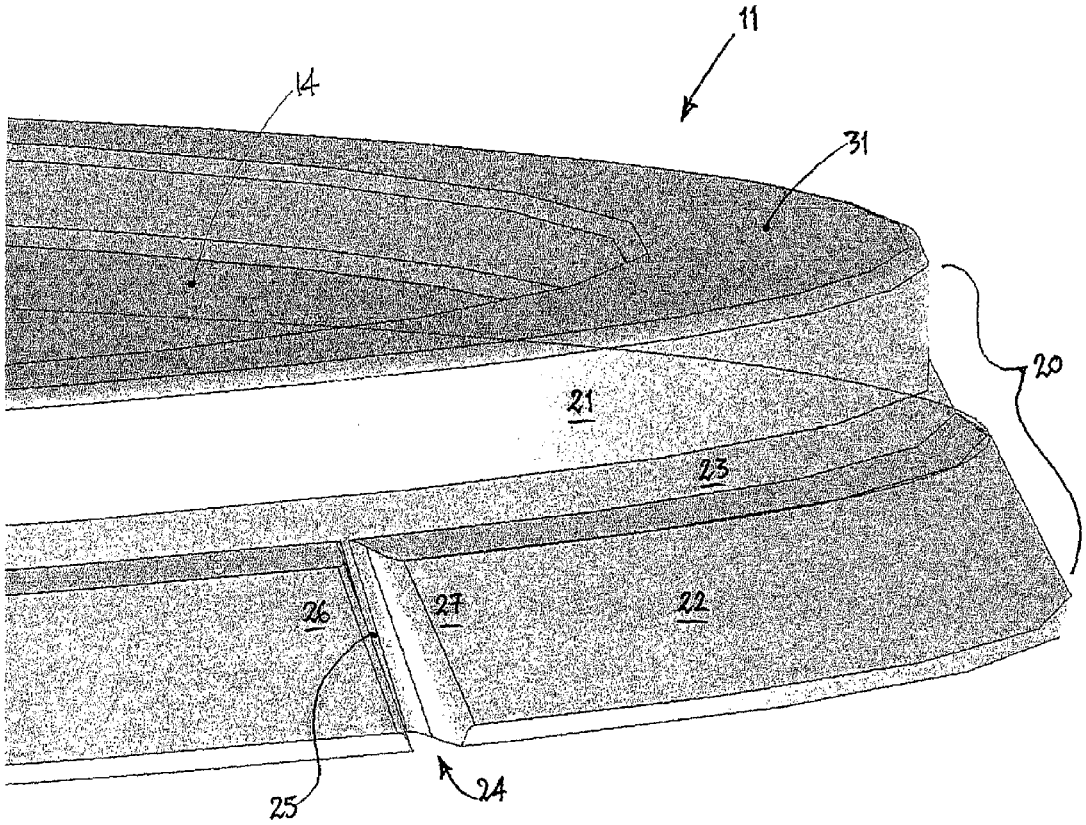
FIG. 2 shows a perspective detail of the closure of FIG. 1 and illustrating a region of deformability.
Figure 3:
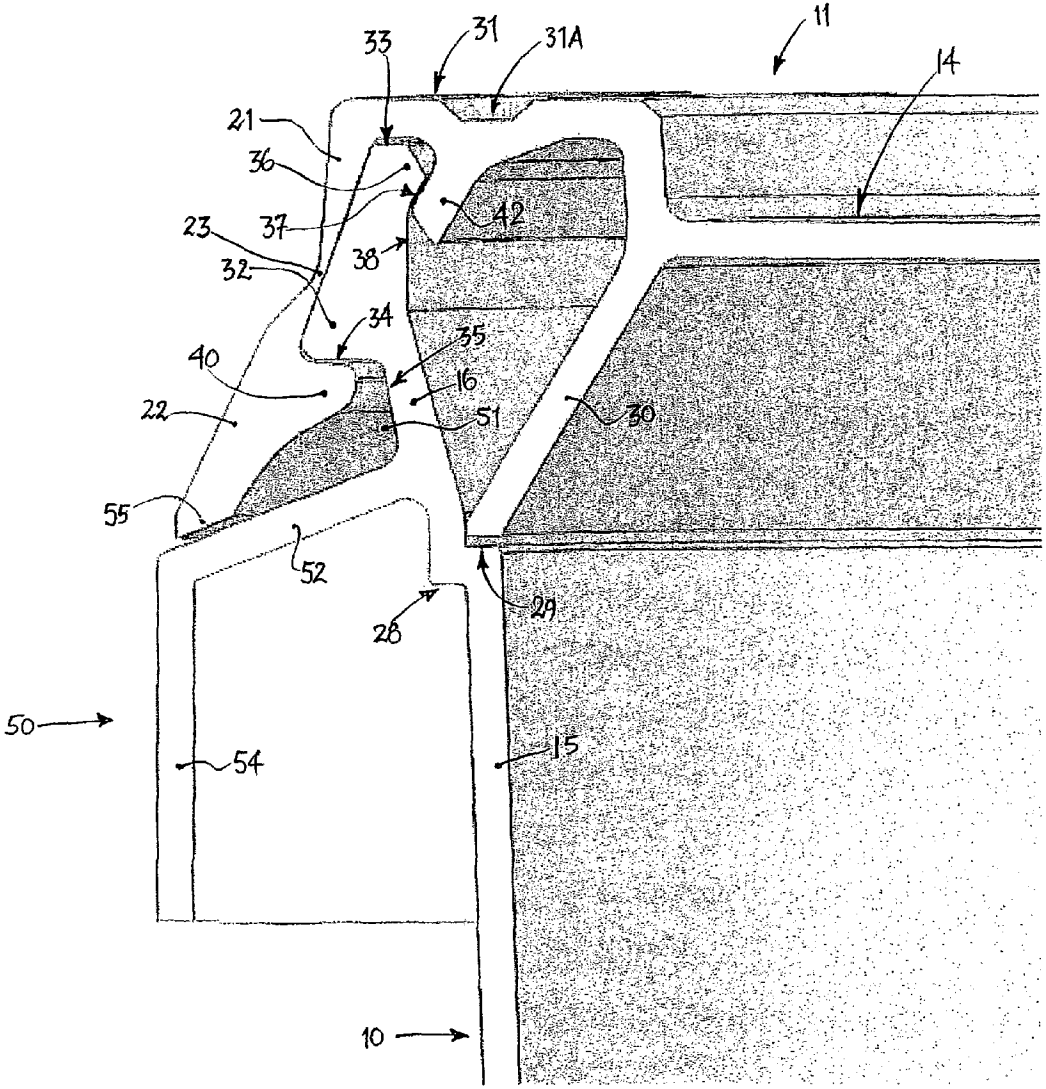
FIG. 3 shows a side sectional view through part of the assembled container-closure arrangement of FIG. 1 in a closure "un-flipped" configuration.

Referring now to FIG. 2, the lid 11 comprises a skirt 20 which surrounds the rim 16 when the lid is first mounted to the pail. Skirt 20 comprises first 21 and second 22 skirt portions, with the second skirt portion optionally also functioning as a removable tear strip or band. In this regard the second skirt portion 22 depends from and is connected (optionally frangibly) to the first skirt portion 21 by way of an integrally moulded thin connecting web 23. The web 23 functions as a living hinge between the first and second skirt portions to enable pivoting of the second skirt portion with respect to the first skirt portion (as described below).

The skirt 20 is generally formed as a continuous wall depending from and extending peripherally around the lid, save for the provision therein of one or more regions of deformability. Each such region is depicted in the form of a transversely extending skirt recess 24 defined in the second skirt portion 22. Typically at least two such recesses are provided in the skirt portion 22, usually on opposing sides of the lid. Whilst each region of deformability is typically embodied as a recess, each region may take other forms, such as a line of material weakness, a line of perforations, a score line, a more general region of reduced thickness etc.

Figure 4:
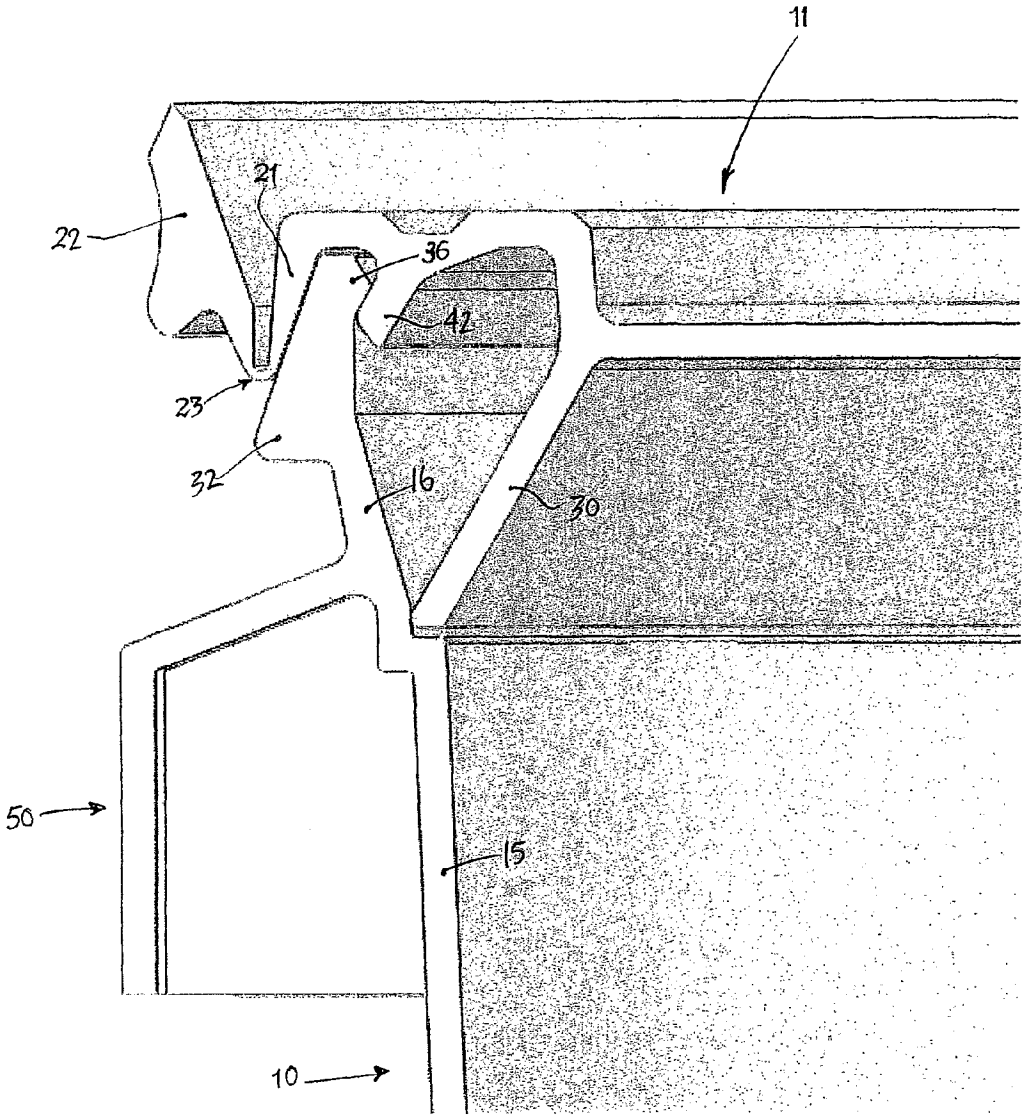
FIG. 4 shows a view similar to FIG. 3 but with the closure in a "flipped" configuration.
Figure 5:
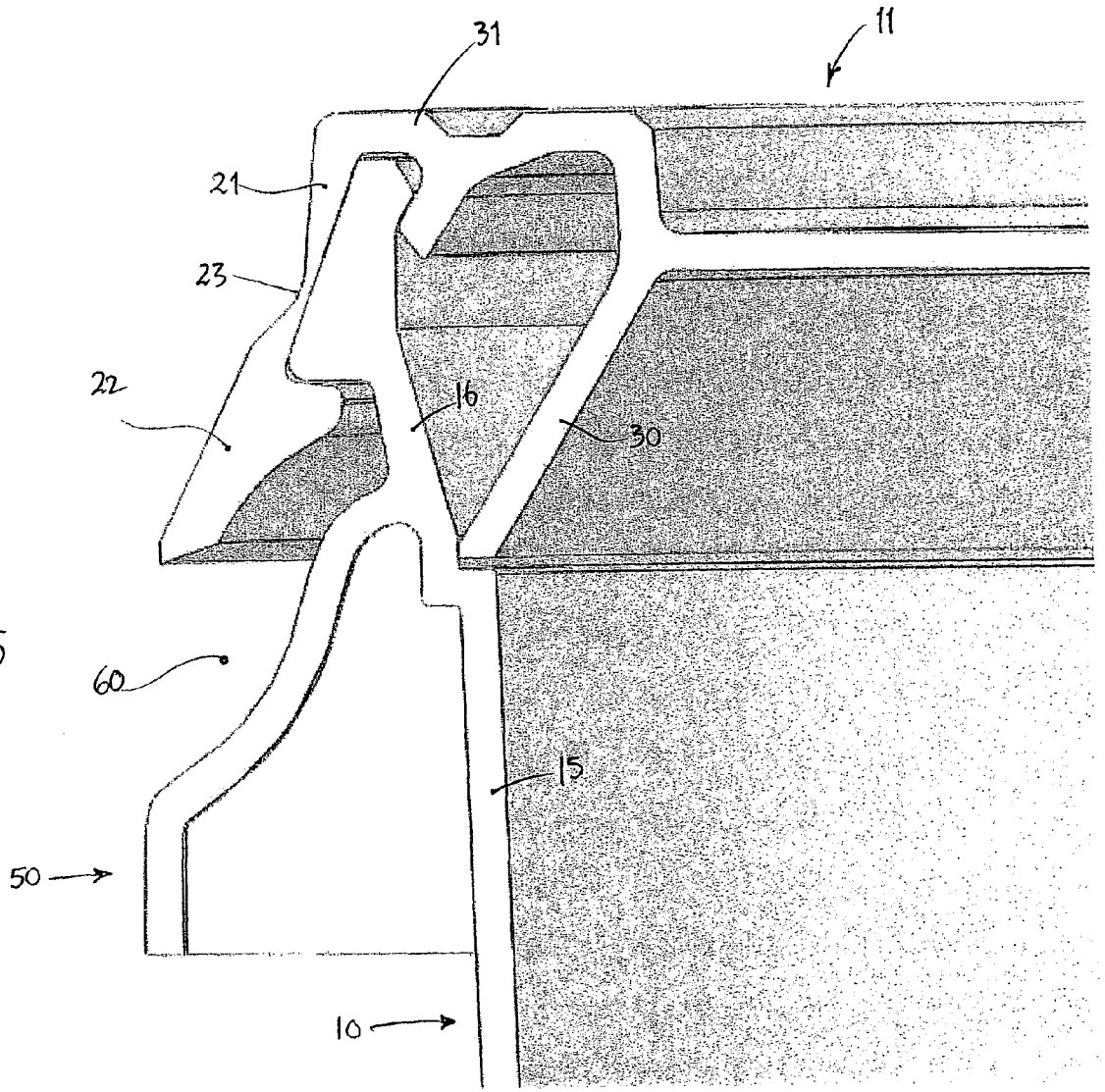
FIG. 5 shows a view similar to FIG. 3 but taken at a location where a flange of the container has a preformed finger recess defined therein.
Figure 6:
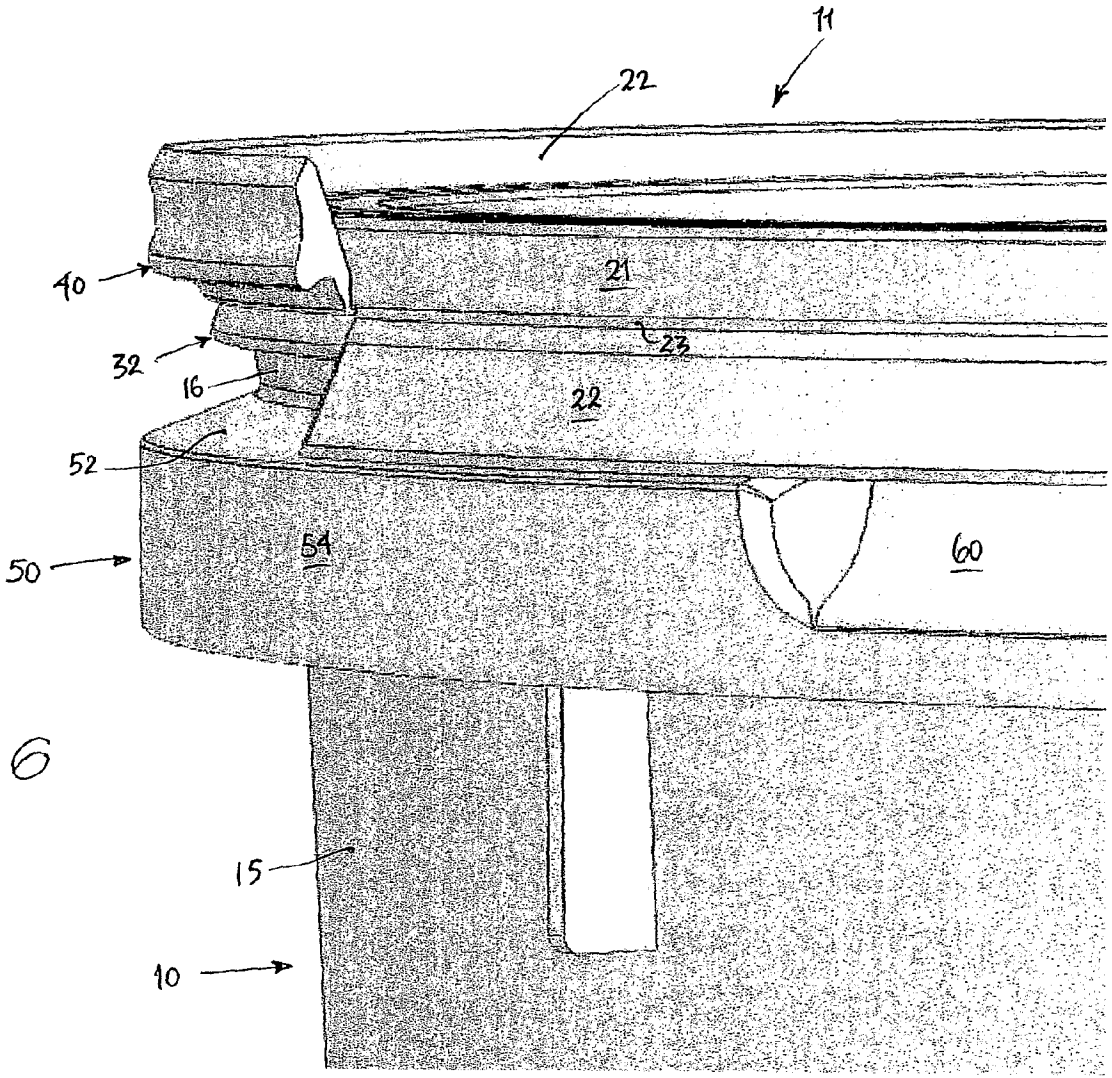
FIG. 6 shows a perspective detail of the container-closure arrangement of FIG. 1 and illustrating part of the closure in a "flipped" configuration.
Figure 7:
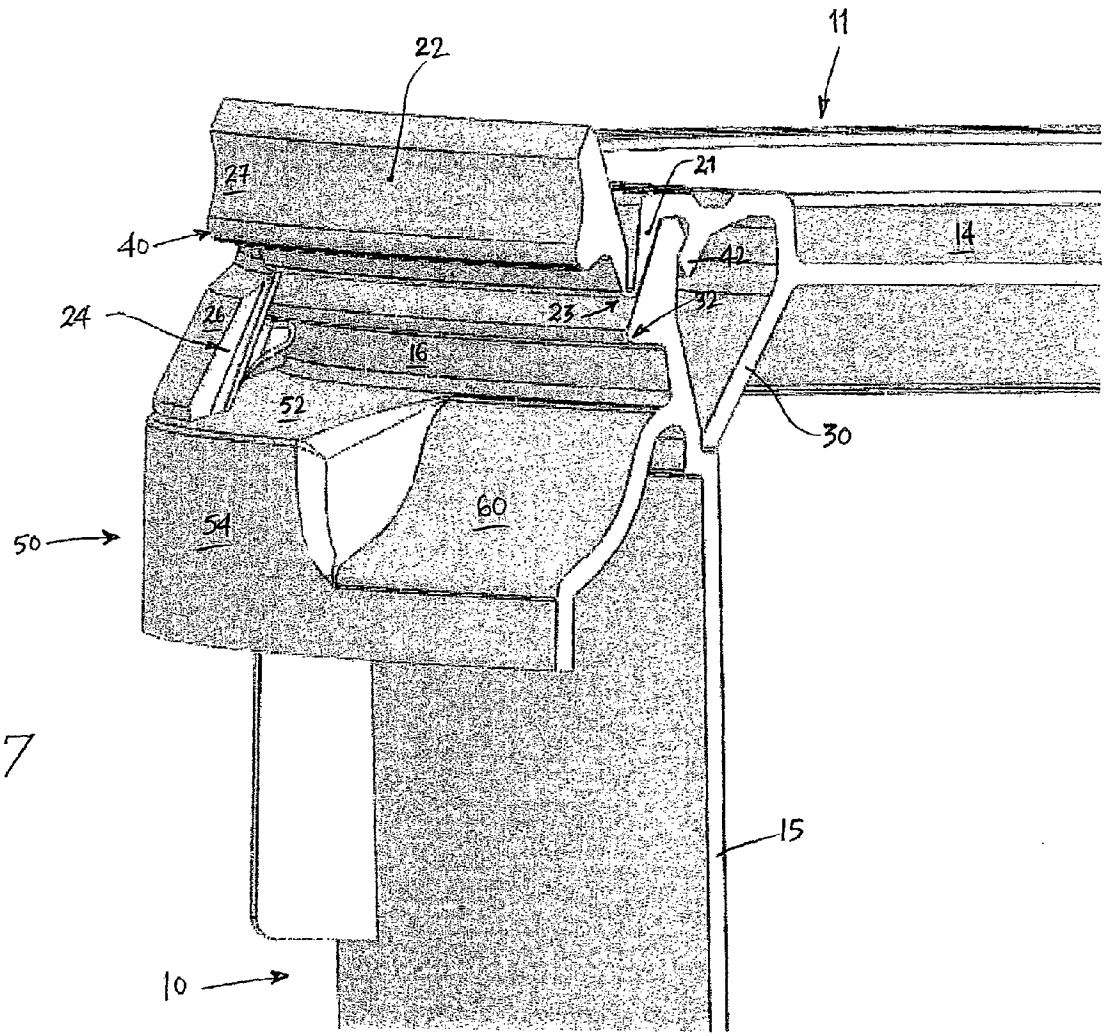
FIG. 7 shows a sectioned perspective detail of the container-closure arrangement of FIG. 1 and illustrating part of the closure in a "flipped" configuration and an underlying preformed finger recess in the container flange.

In the embodiment depicted, each transverse recess 24 is defined by a thin web 25 of skirt material that extends across sides 26, 27 of the skirt portion 22 opposed across the recess. The webs 25 are adapted to not permanently deform during first mounting of the lid on the pail. However, deformation or severing (breaking) of webs 25 enables the second skirt portion to be pivoted (or "flipped") upwardly (as shown in FIGS. 4, 6 and 7). The now upwardly extending skirt portion 22 can be grasped and pulled to complete lid removal.

In an optional variation, the webs 23 and 25 can be fabricated to enable the second skirt portion 22 to function as a removable tear strip or band. In this regard, the web 23 can be frangible or be defined by a line of severance (eg. to be cut with a knife). The opposing sides 26, 27 may each constitute a strip free end, thus providing a manually accessible point of initiation for tearing and removal of skirt portion 22. The sides 26, 27 could also include slightly protruding mouldings or formations to facilitate easier manual grasping. However, should skirt portion 22 be provided as a removable as a tear strip subsequent lid removal may then require the use of a tool.

FIG. 3 shows another optional arrangement where the lid and pail are each adapted for the stacking of one laden container on another. In this regard, the pail rim 16 is offset with respect to the pail wall 15, to define a shoulder 28. The shoulder 28 in turn defines an internal step 29 in the wall 15. A lid stacking skirt 30 can then be provided to extend from an underside of lid 11, the skirt combining with a land 31 of the lid to define an inverted U-shaped channel into which the rim 16 can be inserted when mounting the lid to the pail. Whilst the stacking skirt 30 provides additional rigidity to lid-pail mounting, it also enables one or more laden (eg. like) containers to be stacked on the lid 11. In this regard, the stacking skirt receives the mass of laden container(s) and transfers this mass to the step in the container wall, with the wall then transferring this mass to its base. This can prevent inward collapse of the lid under load.

A land recess 31A (FIG. 3) can provided in land 31 and this recess can receive therein a lower end of the lid stacking skirt 30 of an overlying lid (eg. when one lid is stacked onto another such as after production and for transportation).

In FIG. 3, it will also be seen that the pail rim 16 includes an external protrusion in the form of projecting bead 32 that is formed integrally with and surrounds the rim, the bead 32 being spaced from an upper free end 33 of the rim. The bead 32 has an undersurface 34 that extends from an outer surface 35 of the rim 16. An internal protrusion in the form of projecting bead 36 is formed integrally with and extends internally of and around the rim 16, the bead 36 being defined as part of the rim upper free end 33. The bead 36 has an undersurface 37 that extends from an inner surface 38 of the rim 16.

The bead 32 provides for primary locking of lid 11 to pail 10. Also, where the second skirt portion 22 has been pivoted (or "flipped") up but not detached, as shown in FIG. 4, it can again be pivoted back down to re-establish the primary locking function.

The bead 36 provides for secondary locking of lid 11 to pail 10. For example, after the skirt portion 22 has been disengaged from bead 32 (to remove or disengage primary locking) such secondary locking enables the lid to be re-secured to the pail.

Further, the spacing of the beads as shown, together with the incorporation of bead 36 into rim upper free end 33, make it easier for the lid 11 to be removed from container 10. In this regard, by locating the bead 32 such that is spaced from the rim free end, and by defining the bead 36 as part of the rim free end, once the first ledge is disengaged from the external bead, it is easier to disengage the ledge 42 from the bead 36 (eg. its location and orientation enables pealing away of the lid from the pail).

As part of the primary locking of lid 11 to pail 10, the second skirt portion 22 comprises an inwardly projecting ledge 40 for interlocking engagement with the bead 30 when the lid is first mounted onto the pail as shown. As stated above, pivoting (or "flipping") up of second skirt portion 22 around the hinge defined by web 23 disengages ledge 40 from the bead 32 (FIG. 4).

As part of the secondary locking of lid 11 to pail 10, the lid 11 comprises a ledge 42 projecting inwardly and downwardly from the land 31 of the lid. The ledge 42 interlockingly engages with the bead 36 when the lid is mounted to the pail as shown. As stated above, the ledge 42 and bead 36 are typically configured such that, once second skirt portion bead 32 has been disengaged from ledge 40, the lid may now be "peeled" off the pail by a manual peeling force, that causes bead 36 to disengage with ledge 42.

The dual interlocking engagement between beads 32, 36 and ledges 40, 42 enables the lid to be securely fastened to the pail in that, once assembled, the lid is secured around its periphery by locking on to the beads on both sides of the rim 16, with the rim 16 accordingly being secured within the U-shaped channel. This assists with secure transport and storage of the pail contents.

As also shown in FIG. 3, the second skirt portion 22 has an increased thickness relative to the remainder of skirt 20. The thickness is contributed to in part by the ledge 40. This thickness builds a tensile resistance into the portion 22 that causes the ledge 40 to be urged under (or behind) the bead 36 (ie. in a kind of snap-lock) once the ledge has moved past the bead during mounting of the lid to the pail. In this regard, the thickness and/or skirt material is selected to allow deformation of the second skirt portion during movement past the bead 36, but to impart sufficient resilience to cause the skirt portion to spring back to its original dimension once in the location shown in FIG. 3.

The increased thickness of skirt portion 22 also introduces bi-stability to the portion. That is, it locks in the position of FIG. 3 but, when pivoted (or "flipped") upwardly (FIG. 4), the portion 22 is also held in that position by the tensile resistance. In other words, the skirt portion 22 is stable in two positions (ie. when pivoted down and when pivoted up).

Further, because of the increased thickness the region(s) of deformability also function to enable pivoting of the skirt portion 22. In other words, without the region(s) of deformability pivoting would either be rendered difficult or prevented.

FIG. 3 also clearly shows an annular pail flange 50 formed integrally with the rim 16, the flange projecting to surround the pail peripheral wall 15 and serving, inter alia, to strengthen the pail wall. The flange is located below the level of the bead 32 to define a circumferential groove 51 for the receipt therein of skirt ledge 40. The flange comprises a ledge portion 52 formed integrally with, surrounding and extending out from the rim 16, and a wall portion 54 subtending from the ledge portion 52. The ledge portion 52 is slightly downwardly inclined with respect to the rim 16 (but may extend generally orthogonal thereto).

The flange 50 can also contribute to the tamper-proof mounting of the lid to the pail. In this regard, the second skirt portion 22 is sloped at its free end 55 to match the inclination of ledge portion 52. Further, free end 55 extends down to the ledge portion 52 in a close facing relationship when the lid is mounted to the pail. This close facing relationship (which may eg. be abutment) provides a tamper-proof region between the lid and pail and can help to prevent the insertion of a knife or other sharp or bladed instrument between the lid and pail. However, should such an attempt be made, the close facing relationship ensures that deformation or other damage will result, thereby providing a visual or tactile indication of tampering.

Whilst the flange 50 strengthens the pail it also provides resistance to lateral bumps and blows during transportation. In this regard, and as shown in FIG. 3, the flange projects laterally further than the lid, and thus preferentially receives and absorbs bumps, blows etc. This further contributes to a secure lid mounting in use.

The flange may also comprise one or more recesses 60 extending part-way around the flange to accommodate and enable a user's fingers to be inserted therein (see FIGS. 1 and 5 to 7). Each recess facilitates lifting and pivoting ("flipping") of the second skirt portion 22. This lifting may alternatively be facilitated by an appropriately shaped tool. Recesses may additionally or alternatively be provided in the second skirt portion 22.

Mounting of the lid to the pail may be easily facilitated by hammering the lid onto the pail around land 31, or by positioning a plate or ring-shaped tool onto land 31 of the lid 11 (the plate or tool may optionally have a diameter generally corresponding to land 31). A user (or machine) may then press on the plate or tool to force the lid onto the pail. In any case, during mounting the ledges 40, 42 slide past beads 32, 36, until the position of FIGS. 1 and 3 is reached.

In use, after the container has been filled and the lid has been mounted to the pail, when a user requires access to the pail contents, the second skirt portion 22 is either lifted and pivoted to the positions in FIGS. 4, 6 and 7 by a user inserting fingers into recess 60, or is removed (eg. as a tear strip), in either case detaching ledge 40 from bead 32.

The lifting and pivoting of second skirt portion 22 can occur in one or two stages. For example, half of the skirt portion 22 can be lifted when the lid comprises two (eg. opposing) transverse recesses 24. In this case the web 25 of each recess can sever to enable half-skirt pivoting. This is shown in FIGS. 6 and 7.

Alternatively or additionally, both skirt portion 22 halves can be lifted sequentially or simultaneously, in which case the web 25 of each recess can sever or deform to enable full pivoting of skirt portion 22. Where more than two transverse recesses 24 are employed, various sequences of part-skirt pivoting may ensue.

In any case, when half the skirt portion 22 is pivoted as shown in FIG. 6 the lid is at least partially released from its primary locking position. Depending on the length of the skirt portion that is lifted and pivoted, this may now be sufficient to then enable lid removal. Typically, however, all of the part-skirt portions 22 are pivoted upwardly to best facilitate lid removal.

Then, to complete lid removal, a user may by hand or through the use of an appropriate tool now lift the lid away from the pail to detach ledge 42 from bead 36 (releasing the secondary locking). For example, the upwardly extending (pivoted) skirt portion 22 can be grasped and pulled to effect complete lid removal. In effect, the lid 11 is pealed back from pail 10 to allow access to the pail contents. After such access the lid can be re-mounted by pushing it back on to the pail until ledge 42 interlockingly engages with bead 36, thus partly re-sealing the pail contents. The second skirt portion may optionally then be pivoted back into the primary locking position (eg. when the pail contents are to be stored, transported or later used).

One desirable application for the pivotable second skirt portion 22 configurations described is where a further substance needs to be added and mixed with the pail contents (eg. tinting for paint). After pivoting skirt portion 22 away and pealing back the lid 11 from pail 10, to allow access to pail contents, the further substance can be added to the pail, the lid can be re-mounted by pushing it back on to the pail until ledge 42 interlockingly engages with bead 36, thus partly re-sealing the pail contents and, as necessary, the second skirt portion 22 can be pivoted back into the primary locking position. Now the pail and lid can be shaken etc to mix in the further substance.

Another benefit in employing one or more regions of deformability (such as transverse recesses 24) is that a user can ascertain if an initially mounted lid has been removed or otherwise tampered with, as the region(s) will deform (stretch or break) and thus reveal tampering.

In the embodiments described the lid is formed from deformable and/or deflectable materials to facilitate its mounting onto and removal from the pail. On the other hand, and as required, the pail may be formed from deformable or non-deformable materials such as plastic or metal etc.

Whilst a number of embodiments have been described, it will be appreciated that the closure arrangements described can be embodied in many other forms.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the closure.

The invention claimed is:

1. A closure for a container that comprises a base, a peripheral wall, and a rim, the rim forming an upper margin of the wall and surrounding an opening of the container, wherein a load bearing continuous wall formation is provided within the container adjacent to the rim, the closure comprising:

an overlying portion configured to extend across and to overlie the opening of the container when the closure is mounted to the container;

an inverted peripheral channel section having an inside wall, with the overlying portion being connected to the inside wall at a junction and extending inwardly from the inside wall of the inverted peripheral channel section, and the channel section being configured to mount on the container rim when the closure is mounted to the container; and a load bearing skirt including a single distal end and a single near end, the skirt continuously projecting to the distal end that is located remotely from the inside wall, the skirt continuously projecting from the near end located on an underside of the overlying portion at or adjacent to the junction of the overlying portion with the inside wall of the peripheral channel section such that, when the closure is mounted to the container, the distal end of the skirt is able to mount on the continuous wall formation to form a space between the rim and a remainder of the skirt, the space being above the distal end of the skirt that is mounted on the continuous wall formation, wherein the skirt contacts the continuous wall formation when the overlying portion is under load, so that a mass on the overlying portion is received by the skirt and transferred therefrom to the continuous wall formation to prevent inward collapse of the overlying portion under load.

2. The closure as claimed in claim 1, wherein the load bearing continuous wall formation of the container comprises an internal peripheral step defined therein, the load bearing skirt projects from the overlying portion at the junction with the inside wall of the channel section, and the distal end of the load bearing skirt is configured to mount on the internal peripheral step when the closure is mounted to the container.

3. The closure as claimed in claim 1, wherein the inverted peripheral channel section has, in cross-sectional profile, an inverted U-shape, whereby the overlying portion extends laterally from the inside wall which defines an inside stem of the U-shape, and whereby the rim is received within the U-shape so as to be surrounded at its periphery by an outside stem of the U-shape.

4. The closure as claimed in claim 2, wherein the inverted peripheral channel section generally has, in cross-sectional profile, an inverted U-shape, whereby the overlying portion extends laterally from the inside wall which defines an inside stem of the U-shape, and whereby the rim is received within the U-shape so as to be surrounded at its periphery by an outside stem of the U-shape.

5. The closure as claimed in claim 3, wherein a shorter peripheral skirt projects from an inside face of the inverted U-shape around the periphery of the closure underside, the shorter skirt being configured to engage an inside surface of the rim when the closure is mounted to the container.

6. The closure as claimed in claim 4, wherein a shorter peripheral skirt projects from an inside face of the inverted U-shape around the periphery of the closure underside, the shorter skirt being configured to engage an inside surface of the rim when the closure is mounted to the container.

7. The closure as claimed in claim 5, wherein the outside stem of the U-shape extends to a skirt that is configured to provide an interlocking engagement with a formation defined externally on the rim when the closure is mounted to the container.

8. The closure as claimed in claim 6 wherein the outside stem of the U-shape extends to a third skirt that is configured to provide an interlocking engagement with an external protrusion formed in the rim when the closure is mounted to the container.

* * * * *